United States Patent [19]

Owen

[11] 4,358,665

[45] Nov. 9, 1982

[54] THERMAL CUT-OUT ARRANGEMENT FOR AN ELECTRIC WATER HEATER

[75] Inventor: William G. S. Owen, Langstone near Newport, England

[73] Assignee: IMI Santon Limited, Newport, Great Britain

[21] Appl. No.: 157,840

[22] Filed: Jun. 9, 1980

[30] Foreign Application Priority Data

Jun. 15, 1979 [GB] United Kingdom ..... 7920980

[51] Int. Cl.[3] ..... H05B 1/02; H05B 3/82; F24H 1/20

[52] U.S. Cl. ..... 219/306; 219/308; 219/316; 219/322; 219/328; 219/335; 219/523

[58] Field of Search ..... 219/296, 297, 306–309, 219/316, 318, 321–322, 328, 331, 335, 336, 523

[56] References Cited

U.S. PATENT DOCUMENTS

| | | | |
|---|---|---|---|
| 1,655,413 | 1/1928 | Emerson | 219/306 |
| 1,984,076 | 12/1934 | Monnot | 219/306 |
| 3,626,148 | 12/1971 | Woytowich et al. | 219/306 X |

FOREIGN PATENT DOCUMENTS

| | | | |
|---|---|---|---|
| 1156518 | 10/1963 | Fed. Rep. of Germany | 219/328 |
| 1515174 | 7/1969 | Fed. Rep. of Germany | 219/335 |
| 2023590 | 11/1971 | Fed. Rep. of Germany | 219/306 |
| 924829 | 5/1963 | United Kingdom | 219/322 |
| 1363842 | 8/1974 | United Kingdom | 219/306 |

*Primary Examiner*—A. Bartis

*Attorney, Agent, or Firm*—Cushman, Darby & Cushman

[57] ABSTRACT

An electric water heater of the "instantaneous" type heats the water immediately before use as the water flows through a closed small volume container having a water inlet and a water outlet. An electric high wattage immersion heating element in the container is in circuit with a protective thermal cut-out device mounted on the exterior surface of the container. The heating element has a helically coiled portion with a generally U-shaped portion extending therefrom into thermal contact with a portion of the interior wall of the container directly confronting the thermal cut-out device. The helically coiled portion is positioned between the water inlet and the confronting wall portion and the water inlet is so positioned that the water moves in an unbaffled manner within the helically coiled portion toward the confronting wall portion thereby preventing "nuisance tripping" of the thermal cut-out.

4 Claims, 3 Drawing Figures

THERMAL CUT-OUT ARRANGEMENT FOR AN ELECTRIC WATER HEATER

BACKGROUND OF THE INVENTION

This invention relates to improvements in fluid heating equipment. It is especially concerned with improvements in electrical water heaters of the "instantaneous" type, i.e. heaters where the water is heated immediately before use as it passes through a container of small volume. Instantaneous water heaters have recently come into general use for hot showers, hand washers and other domestic appliances where relatively small flow rates are required.

Instantaneous water heaters need to be both safe and efficient. High wattage heaters up to 7 kW and above are employed to heat water as it passes through a small container, so that if for any reason the power remains connected to the heating element when the water cannot leave the container, as for example in closed outlet heaters, there is a risk that the container could rupture under the high pressure which can rapidly develop. A thermal cut-out or other temperature-related safety device is normally installed at the hottest part of the container to ensure that this cannot happen, but the presence of these cut-outs or other devices can lead to other problems associated with the operation of the heater, particularly where the element has a relatively high heat input.

Although cut-outs of rapid response can be provided, the heat stored in the element at the instant of cut-out may be sufficient to cause the temperature of the relatively small volume of water to rise significantly after the operation of the cut-out. If a cut-out responsive to a lower temperature is installed to overcome this problem, the water heater may be prone to what is known as "nuisance tripping" i.e. the thermal cut-out is triggered during normal use, or by a slight drop in the inlet water pressure.

It is an object of the invention to provide both an improved heating element and a container for housing said element for an instantaneous water heater, which significantly ameliorates the problems set out above.

SUMMARY OF THE INVENTION

According to one aspect of the invention, an electrical heating element for a water heating container includes a helical portion together with a U-shaped portion extending in a plane parallel to the principal axis of the helix and arranged so that the closed part of the U-shaped portion can lie closely adjacent to or in contact with a face of the container extending in a plane perpendicular to the principal axis of the helix.

The closed part of the U-shaped portion may include a linear length of element extending in a plane perpendicular to the principal axis of the helix, so that it can be brazed by a heat transmitting material to a face of the container co-extending in a plane parallel to the linear length. The U-shaped portion of the element preferably extends from within the helical portion thereof.

According to a second aspect of the invention we provide a heating element as defined above in combination with a water heating container, both terminal portions of the element extending through one planar end of the container. The U-shaped portion of the element preferably has a linear length lying adjacent the same planar end.

The container may be made in several parts and may comprise a right cylinder with plane ends. The container may incorporate means for directing inlet water into the region where the linear length of the U-shaped portion lies adjacent to or in contact with the plane end of the container. A thermal cut-out device, responsive to disconnect the electrical supply to the element at a pre-determined temperature, may be secured to the outside of the planar end of the container adjacent the linear length of the element. Such a cut-out device may be a two or three pole isolator.

An outlet to the container may be provided extending from close to the planar end of the container adjacent which lies the closed part of the U-shaped portion of the element, said outlet extending in conduit form through an opposite planar end of the container. Alternatively the outlet from the container may extend through the cylinder wall adjacent the end of the container through which the terminal portions of the element project.

BRIEF DESCRIPTION OF THE DRAWINGS

One embodiment of the invention will now be described, by way of example only, with reference to the accompanying drawings, in which.

DESCRIPTION OF THE PREFERRED EMBODIMENTS

Figure 1:
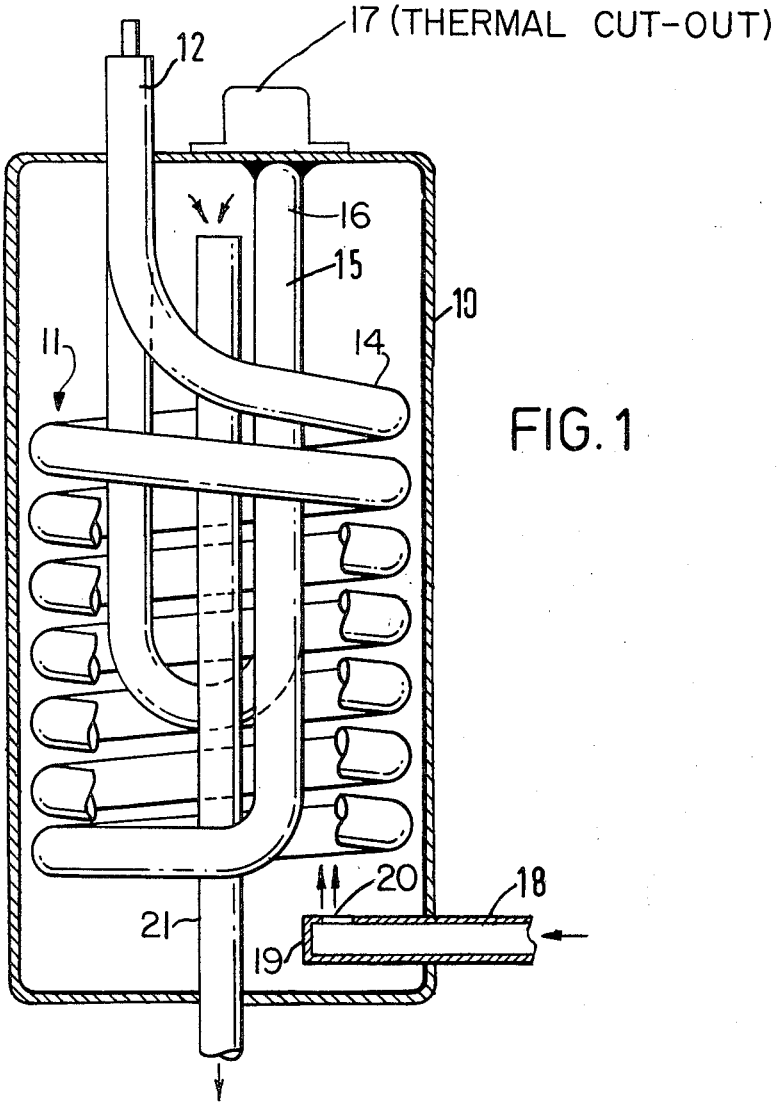
FIG. 1 is a side-elevation, partly cut-away, of a heating element according to the invention within a container.
Figure 2:
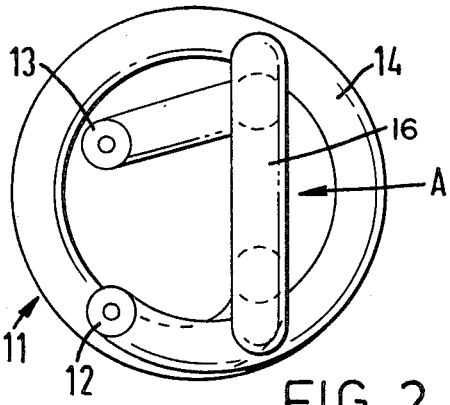
FIG. 2 is a plan view of the element of FIG. 1.
Figure 3:
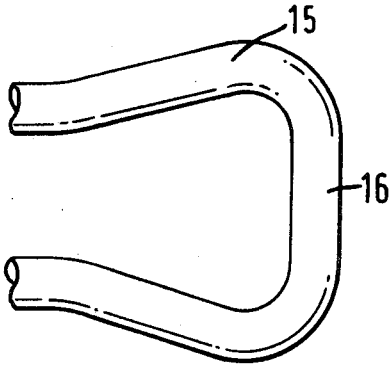
FIG. 3 is a view of part of the element viewed in the direction indicated by arrow A of FIG. 2.

A copper container 10 in the shape of a right cylinder is mounted vertically so that its plane ends face respectively upwards and downwards. The container 10 may be made in two or more pieces which can be soldered or brazed together.

A pre-formed electrical heating element 11 made with a sheath of copper or other corrosion resistant material is positioned within the container 10 so that its two straight terminal portions, 12 and 13 respectively, project through the upper end of container 10. After entering the container from terminal portion 12, the element 11 has a helical portion 14 extending about a vertical axis in a direction towards the base of container 10. The number of turns in the helical portion 14 will depend on the power requirements of the water heater.

Adjacent the container base, the helical portion 14 terminates as the element 11 bends vertically upwards within the helical portion 14. Element 11 continues until it reaches the upper end of container 10 where it is bent back through 180° C. towards the base of container 10 to form a U-shaped portion 15, the closed part of the U touching or positioned very close to the upper end of container 10. A further 180° bend in element 11, within the helical portion 14, takes the element 11 to the other terminal portion 13. The U-shaped portion 15 has a linear portion 16 extending parallel to the inside surface of the upper end of container 10, which portion 16 is brazed to the container to provide good thermal contact at this point.

A thermal cut-out device 17 is mounted on the outside of the upper end of container 10 adjacent the linear portion 16 brazed to the inside surface of the upper end. The cut-out device 17 is designed to operate at a predetermined temperature to isolate the electrical supply to the heating element 11. This temperature will not be reached in normal use of the water heater, since the element is only connected to the electrical supply whilst water is flowing through the container 10. A flow-responsive switch (not shown) is incorporated in the water circuit for this purpose.

If however, for any reason the electrical supply to element 11 is not cut off when the water flow ceases, the thermal cut-out device 17 will isolate the electrical supply to element 11 upon reaching the pre-determined temperature. The cut-out device 17 can be re-set manually but this facility is not usually exposed to the user, since the container 10 and its associated switches, cut-outs etc is housed in a closed casing.

The container 10 has a water inlet extending through its cylindrical wall adjacent the base. The inlet is in the form of a conduit 18 running parallel to the base, which terminates at an end cap 19. An orifice 20 in the uppermost side of conduit 18 directs the inlet water, which is under pressure, upwardly towards the U-shaped portion 15 where it lies adjacent the upper end of container 10. The orifice 20 is positioned so that the helical portion 14 of the element 11 does not baffle the inlet water, so that cold inlet water moves upwardly inside the helical portion 14. We have found that this arrangement of the water inlet, and the direction of the inlet water flow, is important in preventing "nuisance tripping" of the thermal cut-out.

A heated water outlet conduit 21 extends from a position centrally within container 10 above the helical portion 14 of the element 11, through the base of container 10. A control valve (not shown) may be incorporated in the outlet conduit either remotely from or close to the water heater.

I claim:

1. An electric water heater of the type which heats the water immediately before use as the water passes through a container, the heater comprising a closed container, a continuous electric immersion heating element extending within the container, a water inlet to and a water outlet from the container and a thermal cut-out device in circuit with the heating element and mounted on the exterior of the container and adapted to cut off electric current to the heating element at a predetermined temperature, wherein the heating element has a helically coiled portion and a generally U-shaped portion extending from said helically coiled portion, the closed part of said generally U-shaped portion extending substantially into thermal contact with the interior wall of the container directly confronting the thermal cut-out device, the helically coiled portion of the heating element being positioned between the water inlet and the portion of the container wall confronting the thermal cut-out device, and the water inlet being arranged so as to discharge cold water into the interior of the helically coiled portion such that the water moves in an unbaffled manner within the helically coiled portion toward the confronting wall portion of the container, whereby preventing "nuisance tripping" of the thermal cut-out.

2. An electric water heater as according to claim 1 wherein the container has a plurality of faces, at least the uppermost one of which is a plane face, the thermal cut-out device being mounted on said uppermost face, and the heating element being arranged to enter and leave the container through said uppermost face.

3. An electric water heater as according to claim 2 wherein the water heater outlet is in the form of a conduit extending within the container and has an open end adjacent the uppermost face of the container.

4. An electric water heater as according to claim 3 wherein the container is in the form of an upright cylinder with plane end faces, and the water outlet conduit leaves the container through the lower plane end face.

* * * * *